US006680449B1

(12) United States Patent
Wang

(10) Patent No.: US 6,680,449 B1
(45) **Date of Patent: *Jan. 20, 2004**

(54) PRESS BUTTON SWITCH

(76) Inventor: Ming-Shan Wang, No. 16, Alley 25, Lane 127, Lin Sen Road, Kweishan Hsiang, Taoyuan Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/212,756

(22) Filed: Aug. 7, 2002

(51) Int. Cl.[7] ..... H01H 71/16

(52) U.S. Cl. ..... 200/334; 200/520; 200/523; 200/524; 337/66

(58) Field of Search ..... 200/520–525, 200/529–535, 334; 337/36, 56, 62, 66, 85, 113

(56) References Cited

U.S. PATENT DOCUMENTS

| | | | | | |
|---|---|---|---|---|---|
| 3,551,867 | A | * | 12/1970 | Ingwersen | 337/63 |
| 5,532,444 | A | * | 7/1996 | Bonrath et al. | 200/524 |
| 6,335,500 | B1 | * | 1/2002 | Chi et al. | 200/341 |
| 6,417,756 | B1 | * | 7/2002 | Yu | 337/66 |
| 6,483,416 | B2 | * | 11/2002 | Yu | 337/126 |
| 6,504,122 | B2 | * | 1/2003 | Yu | 200/524 |

* cited by examiner

*Primary Examiner*—Michael Friedhofer
(74) *Attorney, Agent, or Firm*—Rosenberg, Klein & Lee

(57) ABSTRACT

A press button switch is constructed to include a seesaw switching mechanism for switching the circuit between on/off positions, a spring-supported press button, and a push member pivoted to the spring-supported press button and controlled by the spring-supported press button to slide along two symmetrical endless sliding tracks and to switch the seesaw switching mechanism between on/off positions.

5 Claims, 14 Drawing Sheets

PRESS BUTTON SWITCH

BACKGROUND OF THE INVENTION

1. Field of the Invention

The present invention relates to electric switches and, more particularly, to a press button switch having a seesaw switching mechanism for switching the circuit between on/off positions.

2. Description of the Related Art

A variety of electric switches, including seesaw switches and press button switches are known. FIG. 1 shows a press button switch 1 according to the prior art. This design uses a press button 11 to move a metal contact plate 12 between on/off positions. The metal contact plate 12 is pivoted to the end portion 15 of one terminal 14 by a hook plate 13, and moved by the push button 11 to switch on/off contacts 17 and 18 subject to the effect of a spring plate 16. This design is not suitable for high current application. For high current application, additional component parts must be added, resulting in complicated structure and high frequency of failure.

FIGS. 2A and 2B show a seesaw switch 2 according to the prior art. This design of seesaw switch 2 uses a plank 21 to move a spring 23 controlled push rod 22, causing the push rod 22 to push a metal contact plate 24 between on/off positions. This design of seesaw switch 2 is suitable for high current application.

FIG. 2C is a sectional view of a seesaw switch 20 according to Taiwan patent publication no. 320355, which was issued to the present inventor. According to this design, turning the plank 201 leftwards or rightwards switches on/off the circuit. When an overcurrent occurred, the metal contact plate 202 automatically trips off.

FIGS. 3A~3E show an overload protective press button switch according to Taiwan patent publication no. 458362. This structure of overload protective press button switch comprises a housing 31, the housing 31 having a top opening 311 and two open chambers 313 and 314 separated by a partition plate 312, a metal contact unit 33 installed in the housing 31, a switching mechanism 35, a press button assembly 32, and a linkage 34. The linkage 34 comprises a spring member 342 supported on the partition plate 312, a press member 341 mounted on the spring member 342, and a swivel holder 344 pivoted to the housing 31. The swivel holder 344 has a guide hole 343, which receives the press member 341, and a positioning portion 345 connected to the switching mechanism 35.

When pressed the press button assembly 32, the press member 341 is forced downwards to compress the spring member 342 and to bias the swivel holder 344, thereby causing the switching mechanism 35 to switch on the metal contact unit 33. When switched on, the spring member 342 pushes the press member 341 back to the initial position. The upper part I of this overload protective press button switch is similar to the design of the aforesaid prior art press button switch. The lower part II of this overload protective press button switch is similar to the design of the aforesaid prior art seesaw switch. This design is similar to Yu's Taiwan utility model no. 83365 (equivalent to U.S. Pat. No. 5,262,748) with the exception of the additional press button assembly 32. The swivel holder 344 is equivalent to Yu's seesaw plank. This structure of overload protective press button switch is complicated, resulting in high manufacturing cost and inconvenience of use. When the push button assembly 32 pressed to the position shown in FIG. 3C, and the swivel holder 344 is biased leftwards, the metal contact unit 33 is switched on. When the user released the hand from the push button assembly 32, the push button assembly 32 is moved to the position shown in FIG. 3D. Viewing from the outside, it shows no difference between the position of 3B and the opposition of 3D, therefore the user cannot know "on" or "off" status of the switch when viewed from the outside. For on/off indication, a complicated indicator circuit must be installed.

SUMMARY OF THE INVENTION

The present invention has been accomplished under the circumstances in view. It is one object of the present invention to provide a press button switch, which enables the user to know "on" or "off" status of the switch when viewed from the outside. It is another object of the present invention to provide a press button switch, which provides the advantages of a seesaw switch. It is still another object of the present invention to provide a press button switch, which is easy and inexpensive to manufacture. It is still another object of the present invention to provide a press button switch, which has indicator means to indicate on/off status. It is still another object of the present invention to provide a press button switch, which achieves the advantages of an overload protective type seesaw switch. It is still another object of the present invention to provide a press button switch, which can easily be reset when tripped off due to an overload. To achieve these and other objects and according to one aspect of the present invention, the press button switch comprises a spring-supported press button, and a push member pivoted to the spring-supported press button and controlled by the spring-supported press button to slide along two symmetrical endless sliding tracks and to switch the seesaw switching mechanism between on/off positions. According to another aspect of the present invention, the endless sliding tracks each have a top positioning point adapted for supporting the press button in "on" position, and a bottom positioning point adapted for supporting the press button in "off" position. Therefore, the user can know "on" or "off" status of the push button switch visually subject to the elevation of the push button. According to still another aspect of the present invention, the seesaw switching mechanism can be equipped with a metal contact plate that automatically trips off upon an overload.

BRIEF DESCRIPTION OF THE DRAWINGS

FIG. 2B is similar to FIG. 2A but showing the seesaw switch switched on.

FIG. 6 is similar to FIG. 5 but showing the press button switch switched on.

DETAILED DESCRIPTION OF THE PREFERRED EMBODIMENT

Figure 1:
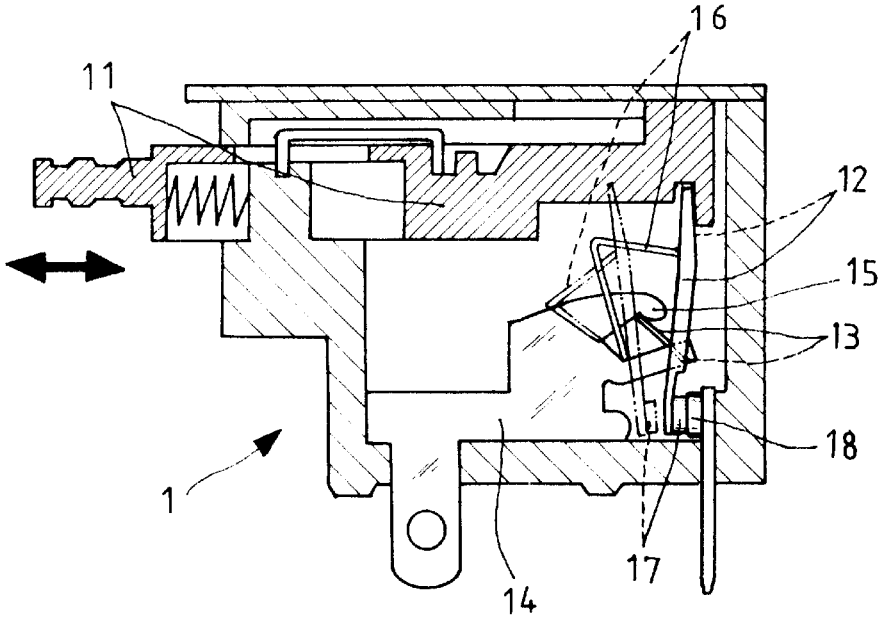
FIG. 1 PRIOR ART
FIG. 1 is a sectional view of a press button switch according to the prior art.
Figure 2C:
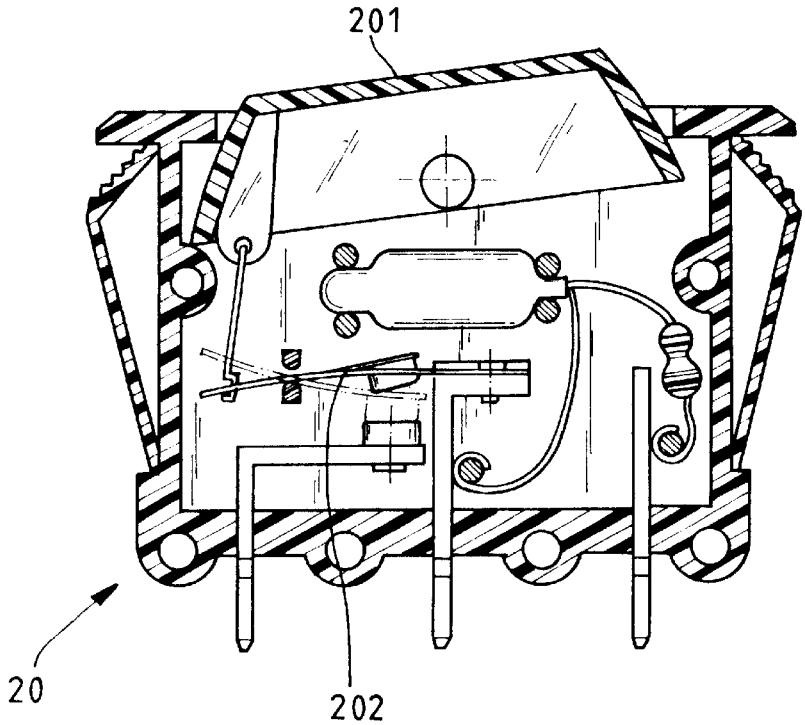
FIG. 2(C) PRIOR ART
FIG. 2C is a sectional view of a seesaw switch according to Taiwan patent publication no. 320355, issued to the present inventor.
Figure 2A:
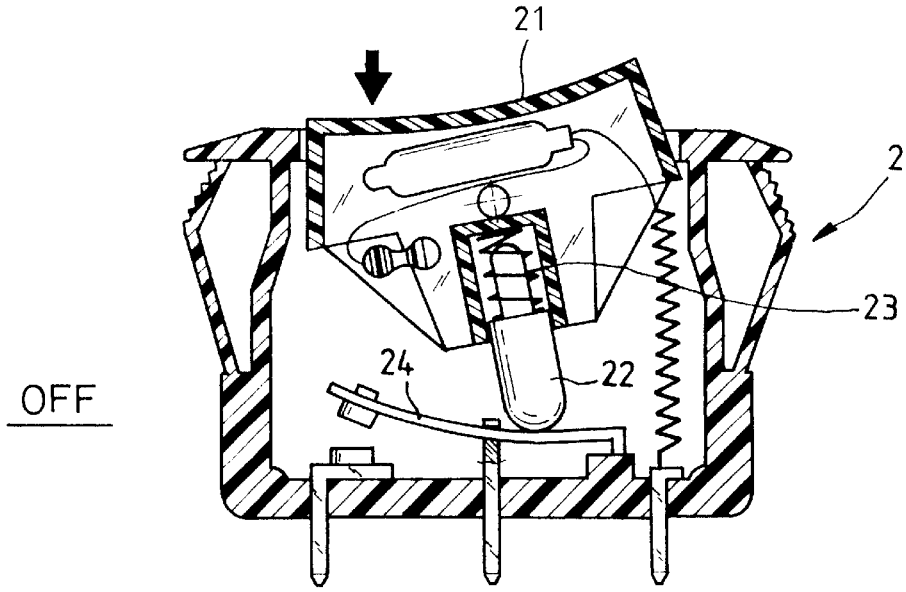
FIG. 2(A) PRIOR ART
FIG. 2A is a sectional view of a seesaw switch according to the prior art when turned off.
Figure 2B:
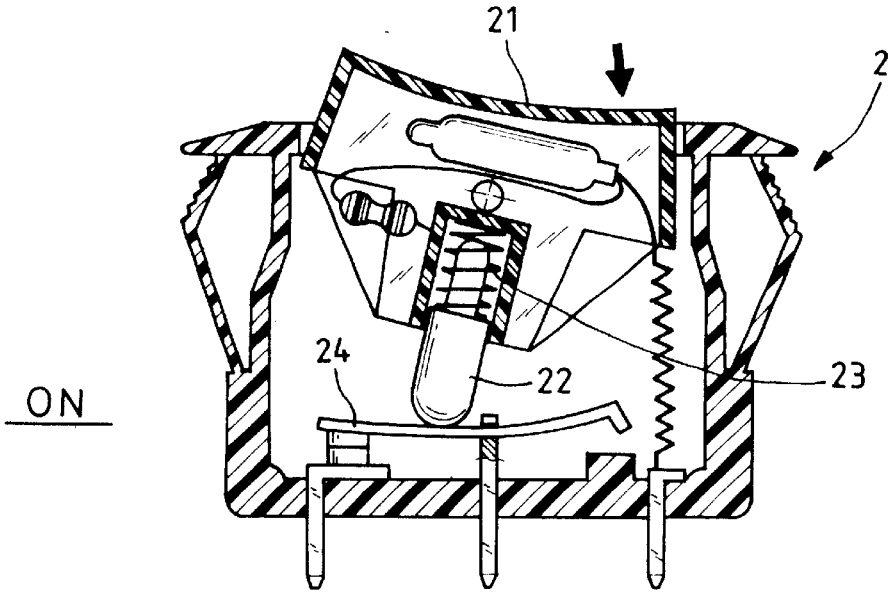
FIG.2(B) PRIOR ART
Figure 3A:
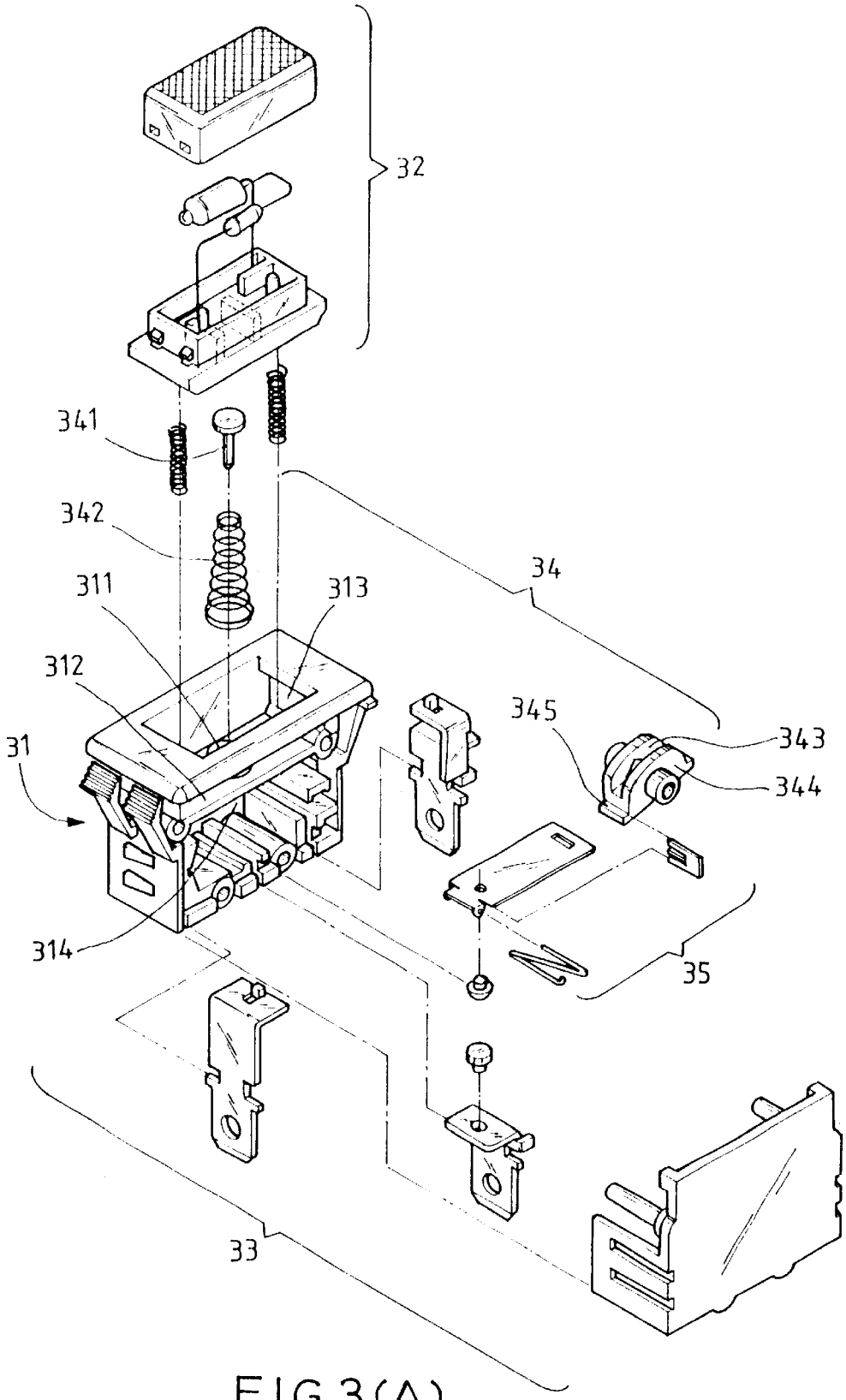
FIG.3(A) PRIOR ART
FIG. 3A is an exploded view of an overload protective press button switch according to Taiwan patent publication no. 458362.
Figure 3B:
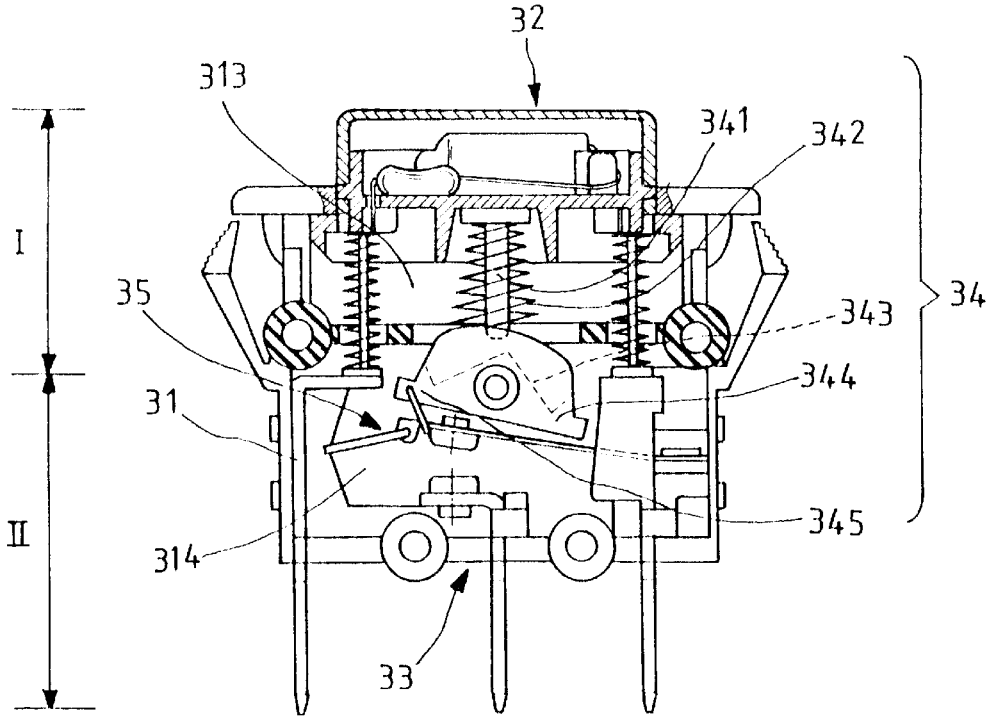
FIG. 3(B) PRIOR ART
FIGS. 3B~3C show the actions of the overload protective press button switch of FIG. 3A.
Figure 3C:
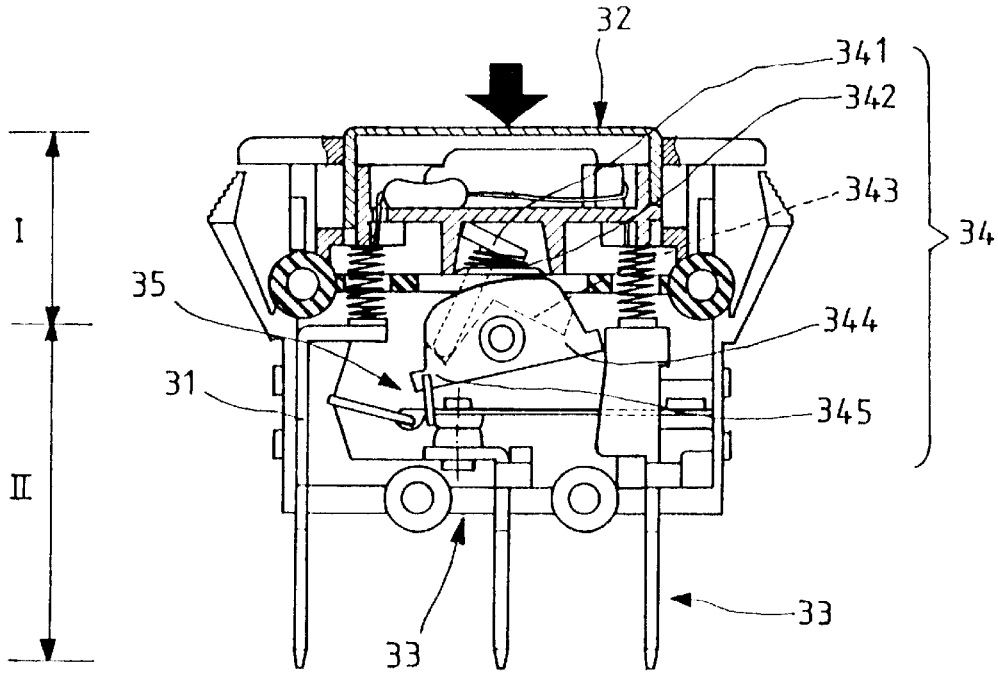
FIG. 3(C) PRIOR ART
Figure 3D:
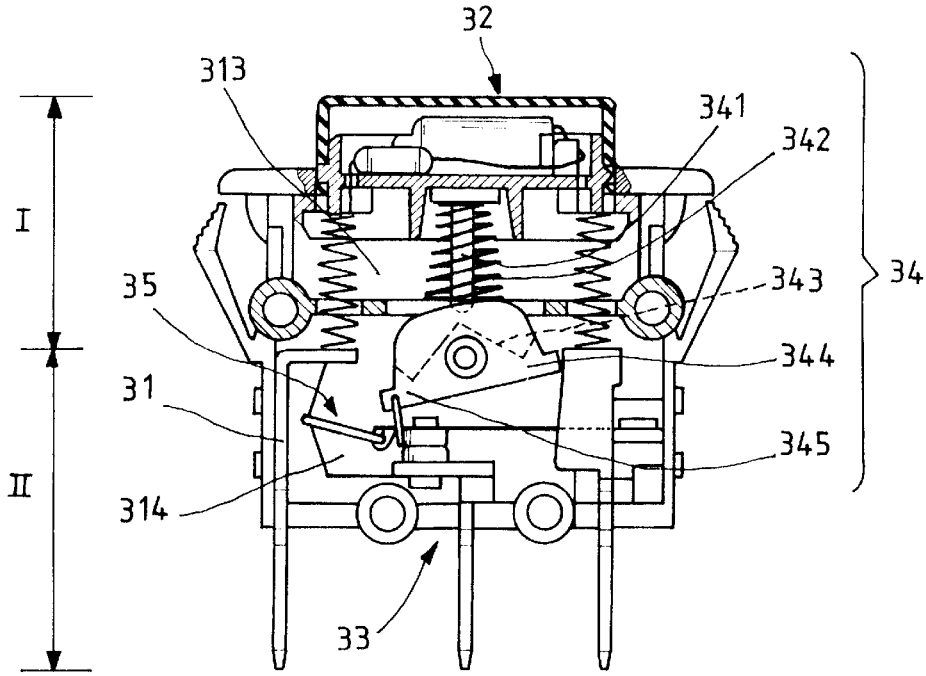
FIG. 3(D) PRIOR ART
FIG. 3D is a sectional view of a prior art press button switch in a first position.
Figure 3E:
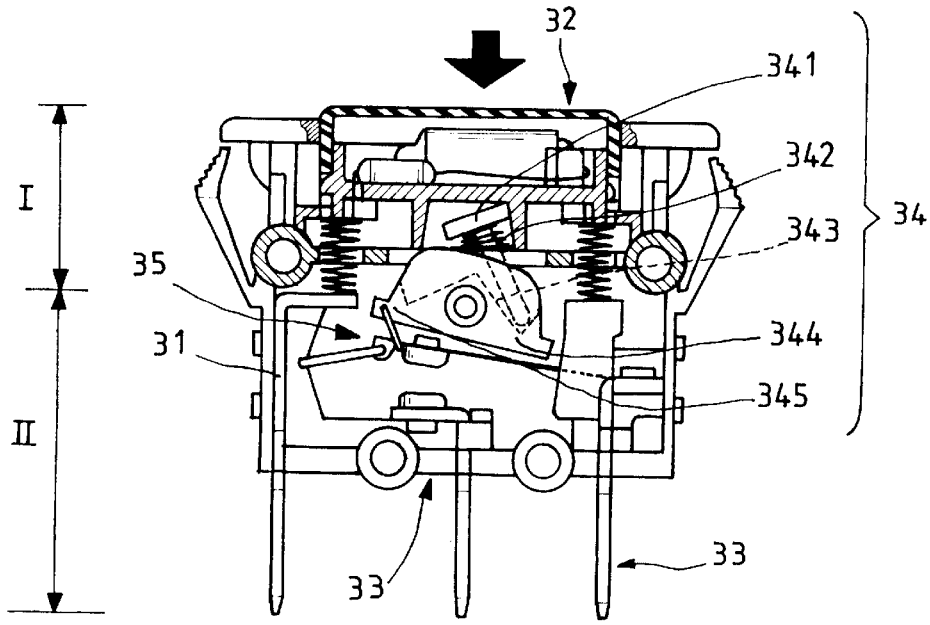
FIG.3(E) PRIOR ART
FIG. 3E is a sectional view of a prior art press button switch in a second position.

Referring to FIGS. From 4 through 9, a press button switch is shown comprising a housing 4, a press button 5, three terminals 6 (the first terminal 6*a*, the second terminal 6*b*, and the third terminal 6*c*), a seesaw switching mechanism 7, and an actuating structure 8.

The housing 4 is a hollow member having a top opening 42, and a side cover 41 covered on one lateral open side thereof. The press button 5 is vertically movably mounted in the top opening 42 of the housing 4 and supported on springs 51. The terminals 6 are mounted in the housing 4 at a bottom side. The seesaw switching mechanism 7 is installed in the housing 4, and controlled to switch on/off the circuit of the terminals 6. The actuating structure 8 is installed in the housing 4, and controlled by the press button 5 to move the seesaw switching mechanism 7 between on/off positions.

Figure 4:
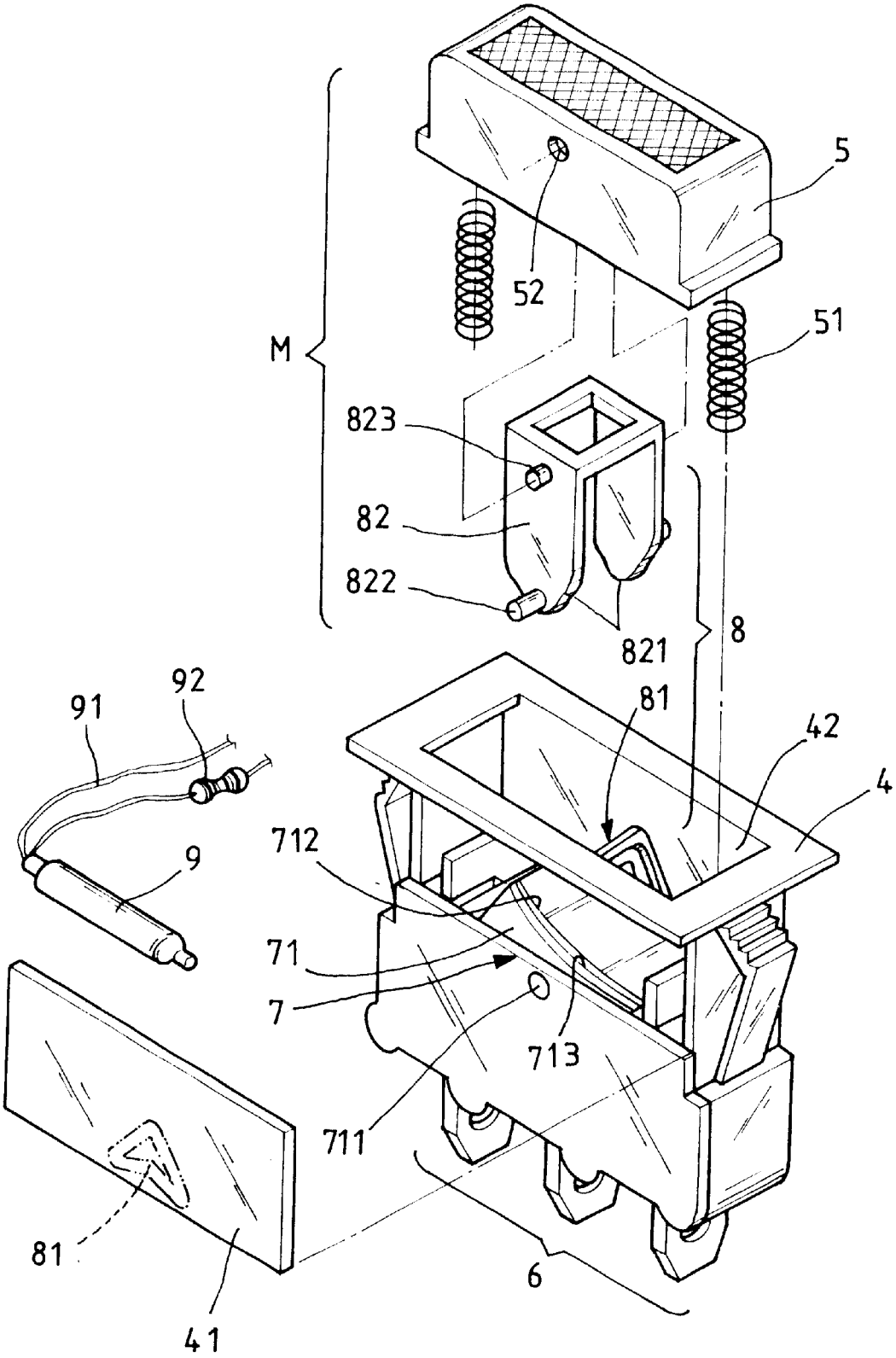
FIG. 4 is an exploded view of a press button switch according to the present invention.
Figure 5:
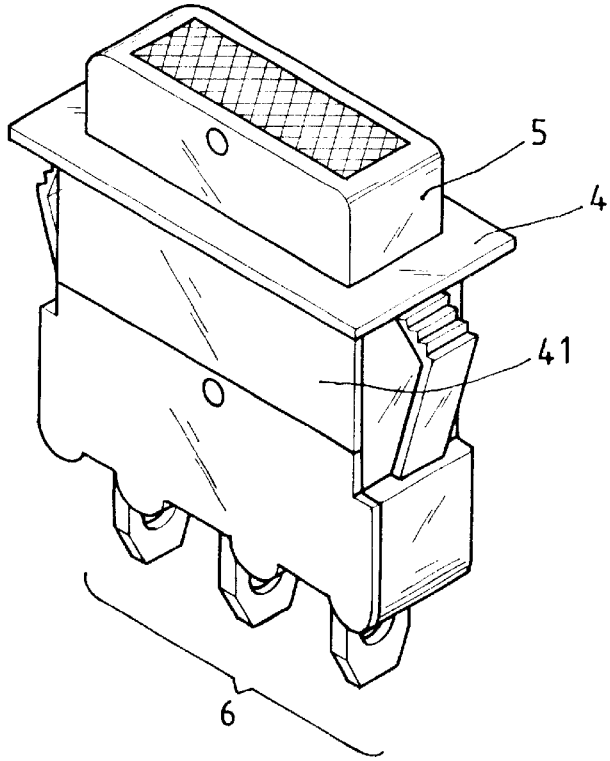
FIG. 5 is an elevational view of the present invention, showing the press button switch switched off.
Figure 6:
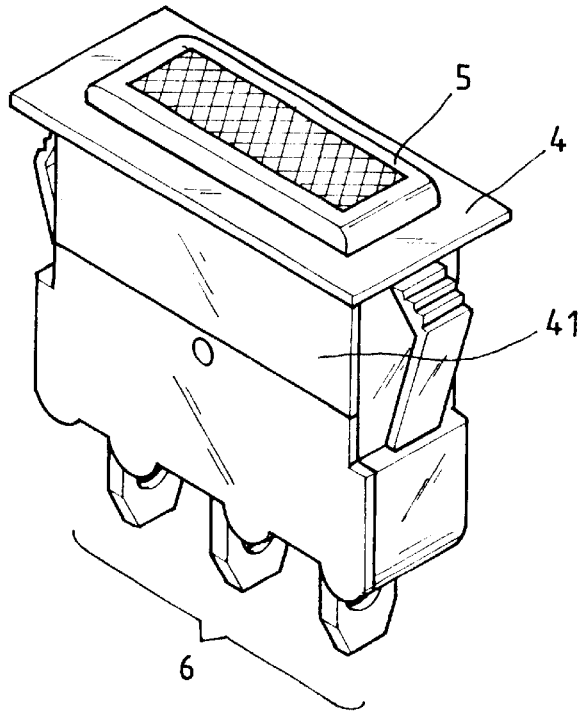
Figure 9:
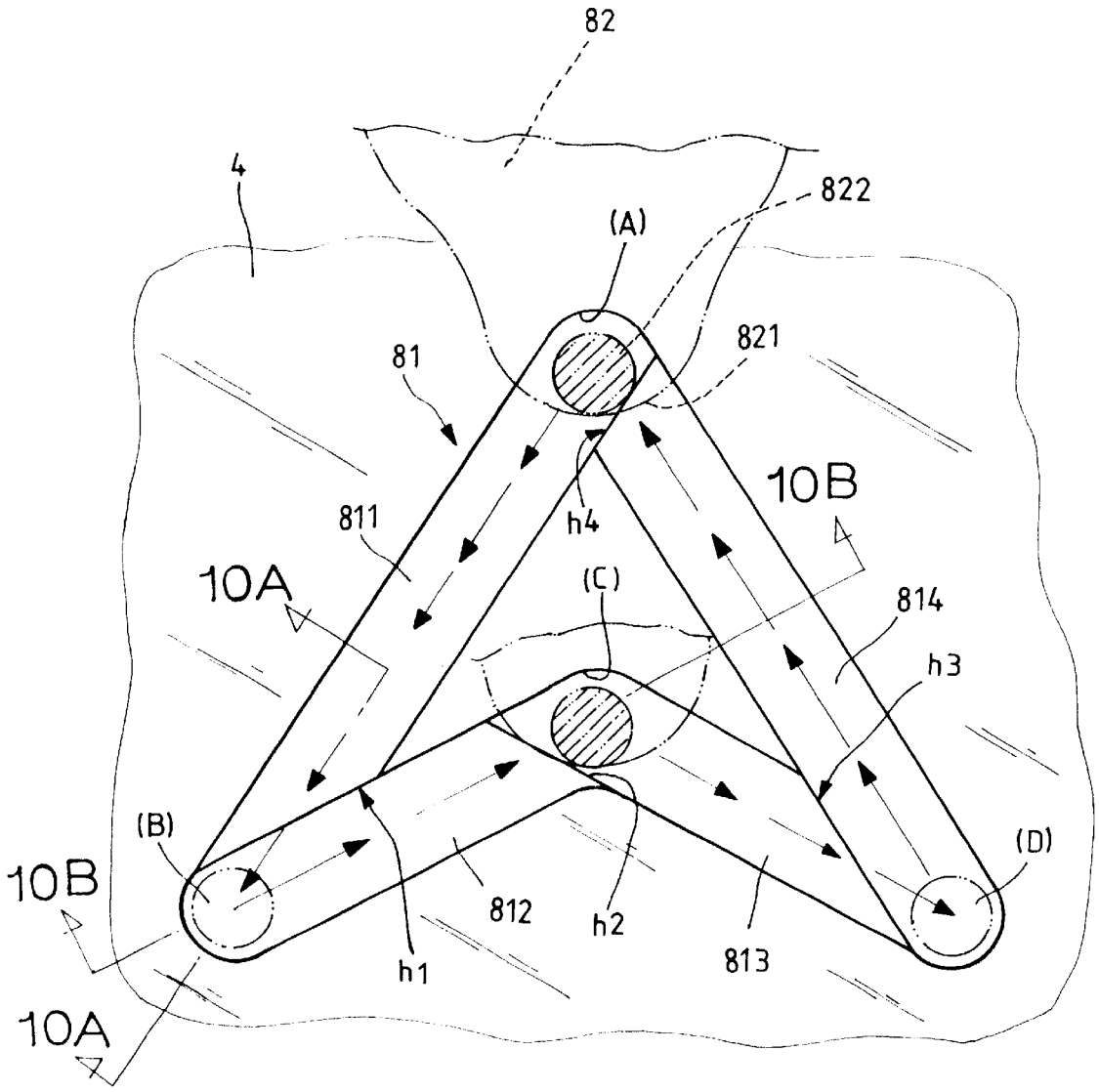
FIG. 9 is a schematic drawing showing the design of the endless sliding track according to the present invention.

The actuating structure 8 comprises two endless sliding tracks 81 bilaterally provided inside the housing 4, and a push member 82 (one of the endless sliding tracks 81 is formed in the inner side of the side cover 41). Each endless sliding track 81 is formed of four sliding rails 811*m* 812*m* 813 and 814 connected to one another, forming a top positioning point A at the connecting area between the first sliding rail 811 and the fourth sliding rail 814, a bottom positioning point C at the connecting area between the second sliding rail 812 and the third sliding rail 813, a first turning point B at the connecting area between the first sliding rail 811 and the second sliding rail 812, and a second turning point D at the connecting point between the third sliding rail 813 and the fourth sliding rail 814 (see FIG. 9). The top positioning point A and the bottom positioning point C are vertically aligned and disposed above the elevation of the first turning point B and the second turning point D. The first turning point B and the second turning point D are equally spaced from the bottom positioning point D at two sides. The press button 5 is shaped like a rectangular cap, having two pivot holes 52 aligned at two sides. As illustrated in FIG. 4, the push member 82 is a substantially Π-shaped member injection-molded from springy plastics, having two horizontal pivot rods 823 respectively perpendicularly extended from two opposite vertical lateral sidewalls thereof near the top and respectively coupled to the pivot holes 52 of the press button 5, two bottom push portion 821 pressed on the flank of the seesaw switching mechanism 7, and two guide rods 822 respectively perpendicularly extended from the two opposite vertical lateral sidewalls adjacent the bottom push portions 821 and respectively slidably coupled to the sliding tracks 81 for moving along the sliding tracks 81 to guide the plank 71 of the seesaw switching mechanism 7 between on/off positions. The push member 82 forms with the press button 5 a linkage M.

Figure 8B:
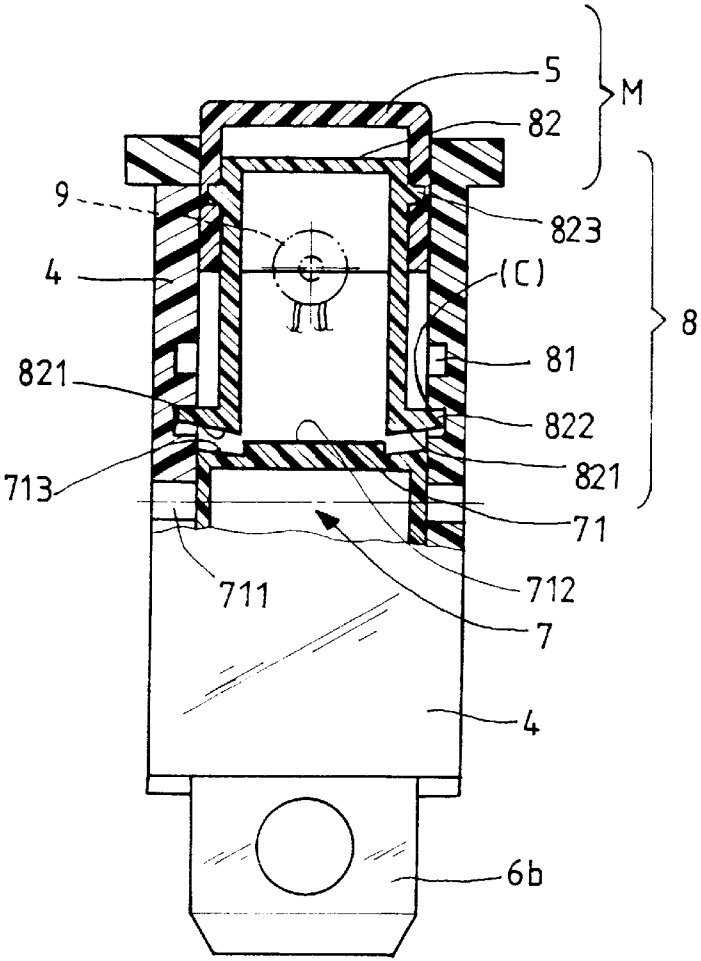
FIG. 8B is a sectional view, in an enlarged scale, taken along line 8B—8B of FIG. 7C.
Figure 8A:
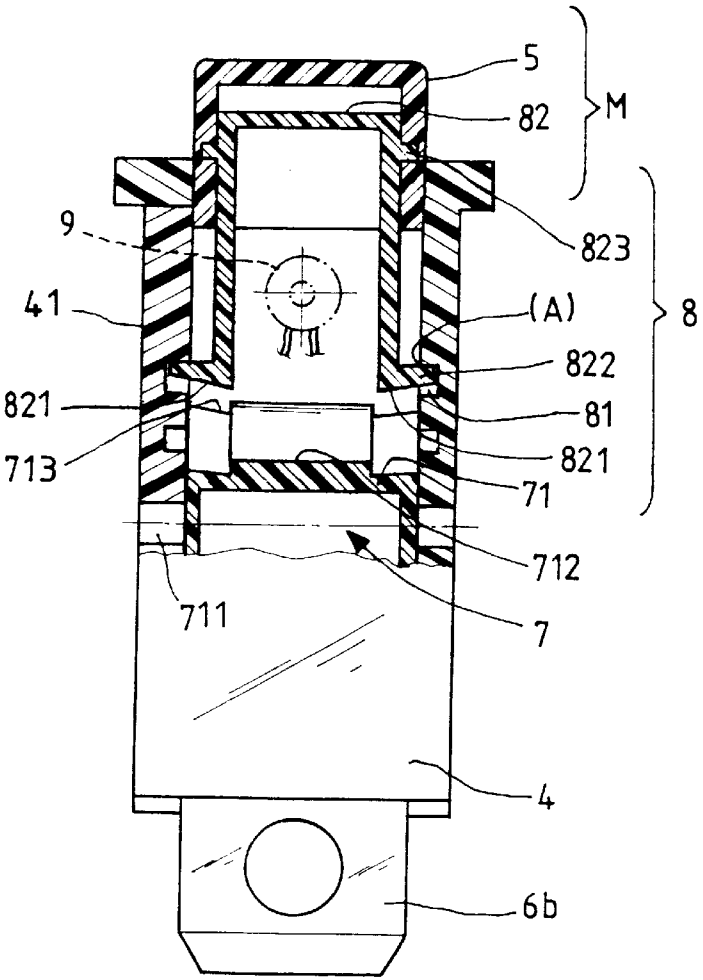
FIG. 8A is a sectional view, in an enlarged scale, taken along line 8A—8A of FIG. 7A.

As illustrated in FIGS. 4, 8A and 8B, the plank 71 of the seesaw switching mechanism 7 has two pivot rods 711 respectively perpendicularly extended from two opposite lateral sidewalls thereof and respectively pivoted to the two opposite vertical lateral sidewalls of the housing 4. The top side of the plank 71 is smoothly curved inwards, having a protruded middle portion 712 and two elongated side bearing portions 713 respectively sloping toward the protruded middle portion 712 at a lower elevation than the protruded middle portion 712. When installed, the bottom push portions 821 of the push member 82 are respectively stopped at the side bearing portions 713 of the plank 71 of the seesaw switching mechanism 7. Because the side bearing portions 713 respectively sloping downwards toward the protruded middle portion 712, the push member 82 is maintained coupled to the plank 71 of the seesaw switching mechanism 7 for positive switching control. Further, the springy material property of the push member 82 keeps the guide rods 822 coupled to the sliding tracks 81 of the actuating structure 8.

Figure 10A:
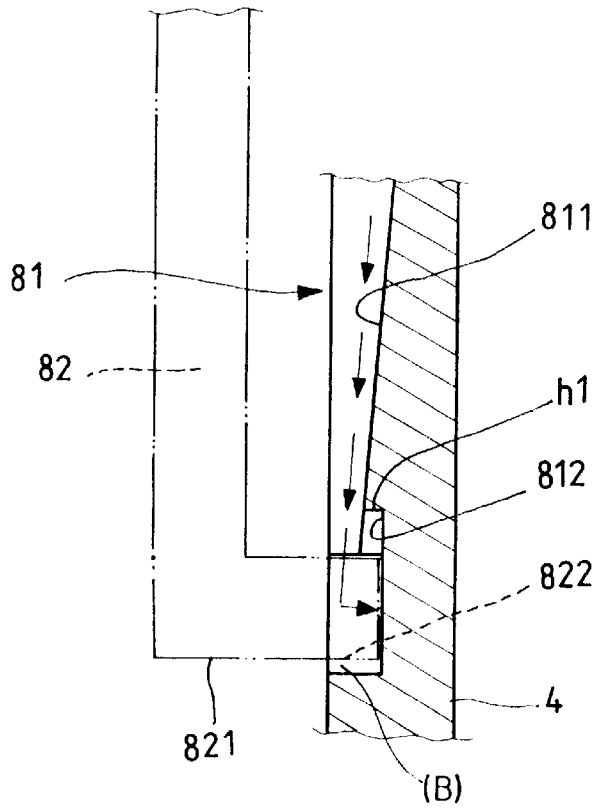
FIG. 10A is a sectional view taken along line 10A—10A of FIG. 9.
Figure 10B:
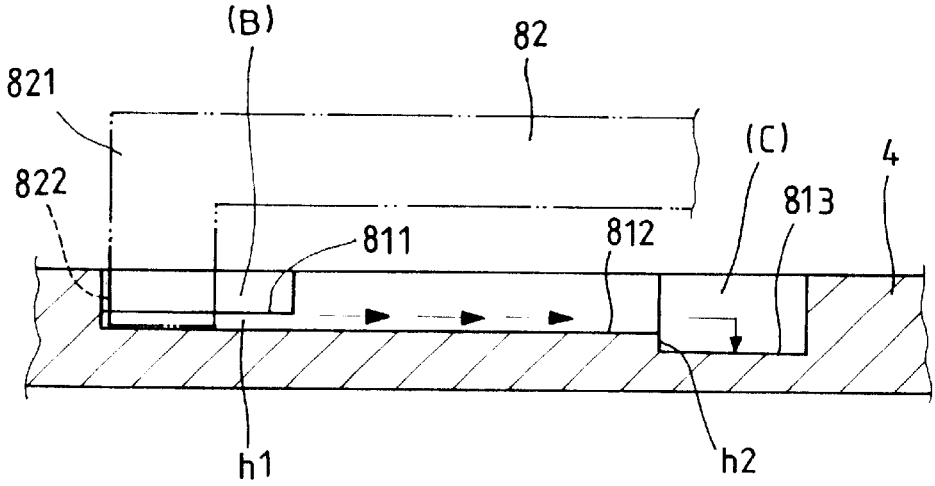
FIG. 10B is a sectional view taken along line 10B—10B of FIG. 9.
Figure 11:
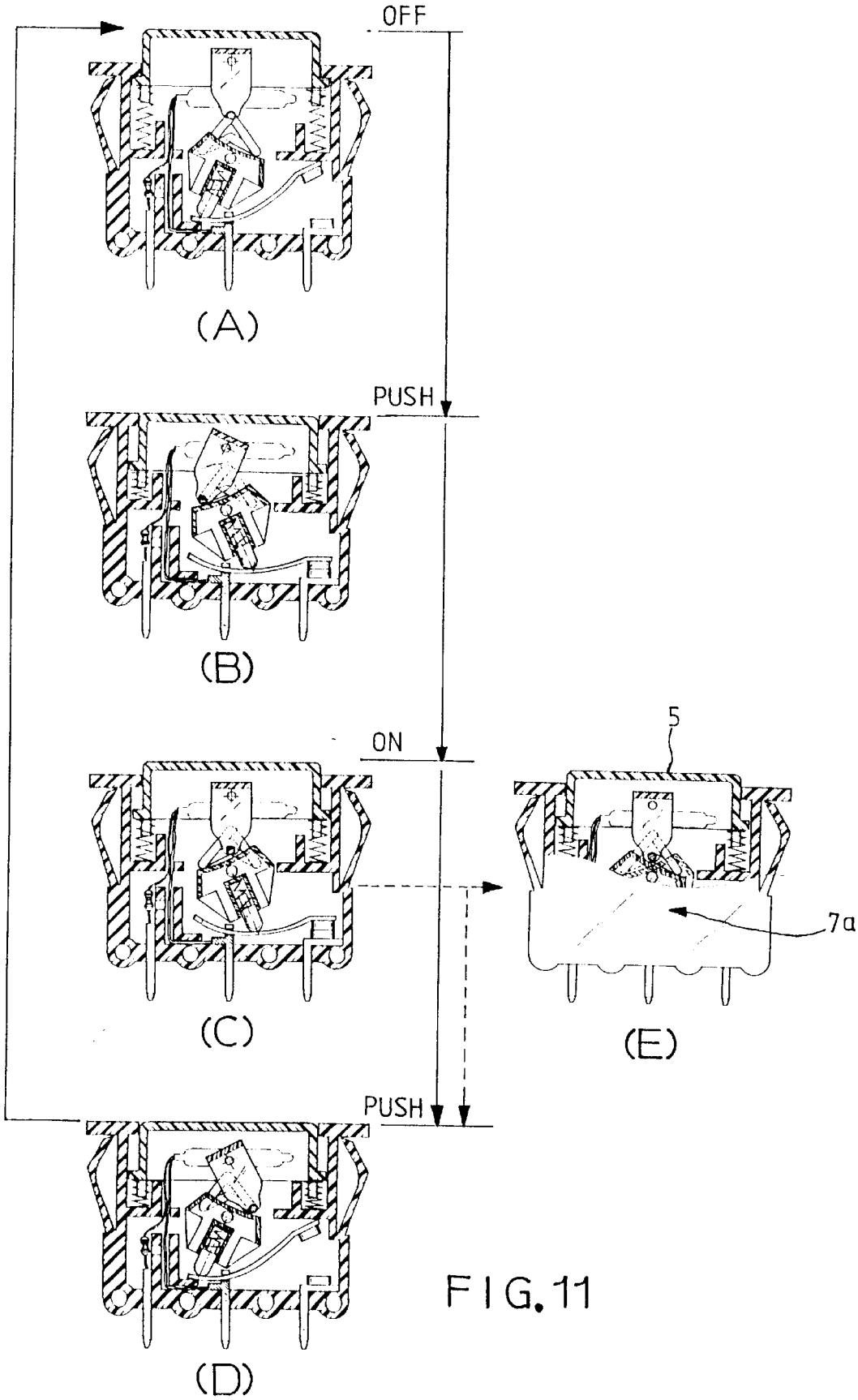
FIG. 11 is a schematic drawing showing the continuous switching actions of the present invention.

Referring to FIGS. 10A and 10B, there are elevational differences h1, h2, h3, and h4 respectively disposed in the connecting area between the first sliding rail 811 and the second sliding rail 812, the connecting area between the second sliding rail 812 and the third sliding rail 813, the connecting area between the third sliding rail 813 and the fourth sliding rail 814, and the connecting area between the fourth sliding rail 814 and the first sliding rail 811, such that the guide rods 822 are confined to the moving direction along the sliding rails in the order of 811□812□813□814.

Referring to FIGS. 7A~7D and FIG. 9, when switched off, the press button 5, the guide rods 822 of the push member 82 are respectively positioned in the top positioning points A of the sliding tracks 81, and the press button 5 are supported in the upper limit position. When pushing the press button 5 downwards from the upper limit position shown in FIG. 7A to the elevation of the top side of the housing 4, i.e., the lower limit position shown in FIG. 7B, the guide rods 822 of the push member 8 are moved along the first sliding rail 811 to the first turning point B. At this time, the bottom push portions 821 of the push member 82 forces the plank 71 to tilt, and the metal contact plate 74 of the seesaw switching mechanism 7 is forced by the spring 72 and push rod 73 of the seesaw switching mechanism 7 toward the first terminal 6*a*, thereby causing the end contact portion 741 of the metal contact plate 74 to contact the contact portion 61 of the first terminal 6*a* and to further switch on the switch. When releasing the hand from the press button 5 at this time, the springs 51 immediately push the press button 5 upwards, thereby causing the guide rods 822 to be moved upwards along the second sliding track 812 to the bottom positioning point C (see FIG. 7C and FIG. 9). At this time, the press button 5 partially protrudes over the top side of the housing 4, and the switch is maintained in the "on" position.

Figure 7A:
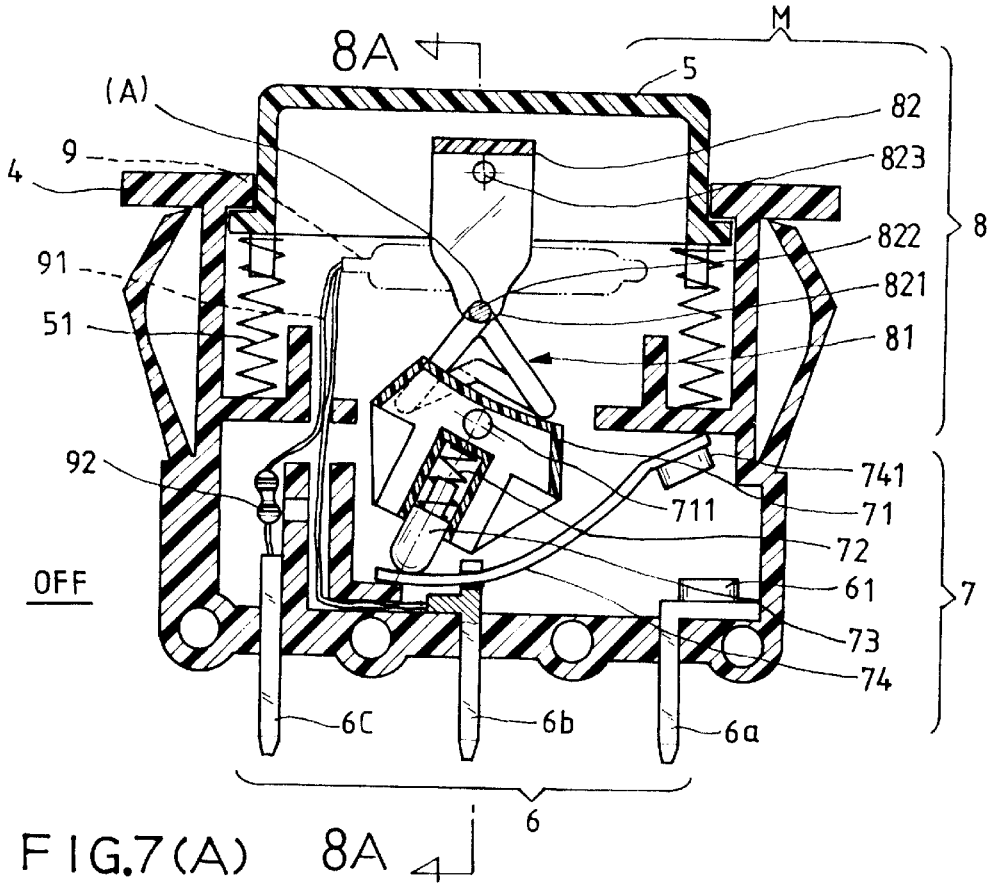
FIG. 7A is a sectional view of the present invention, showing the press button switch switched off.
Figure 7B:
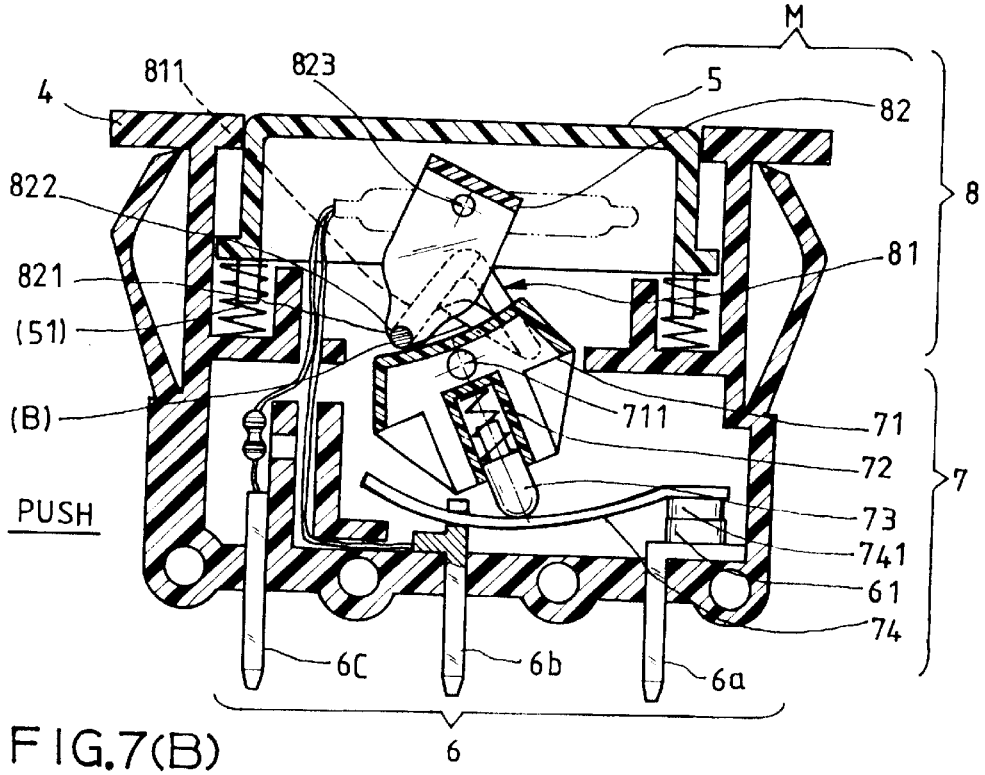
FIG. 7B is similar to FIG. 7A but showing the press button pressed.
Figure 7:
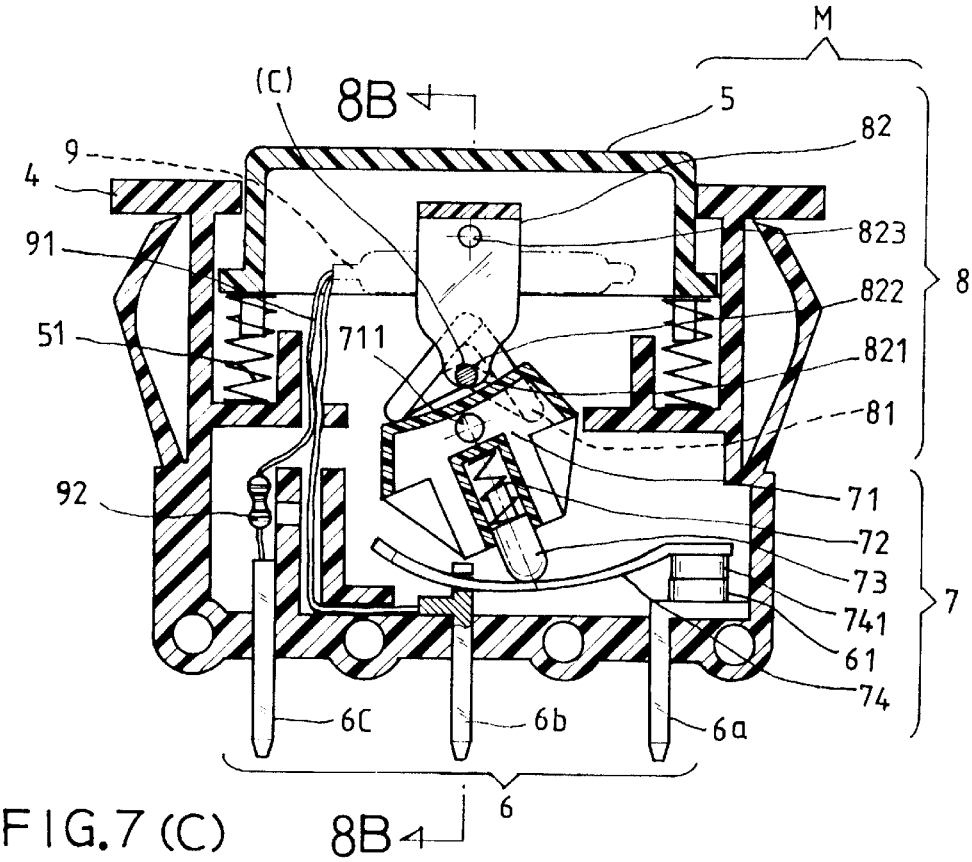
FIG. 7C is a sectional view of the present invention, showing the press button switch maintained in "on" position.
FIG. 7D is similar to FIG. 7C but showing the press button pressed.
FIG. 7E is a schematic drawing the seesaw switching mechanism tripped off upon an overcurrent.
Figure 7:
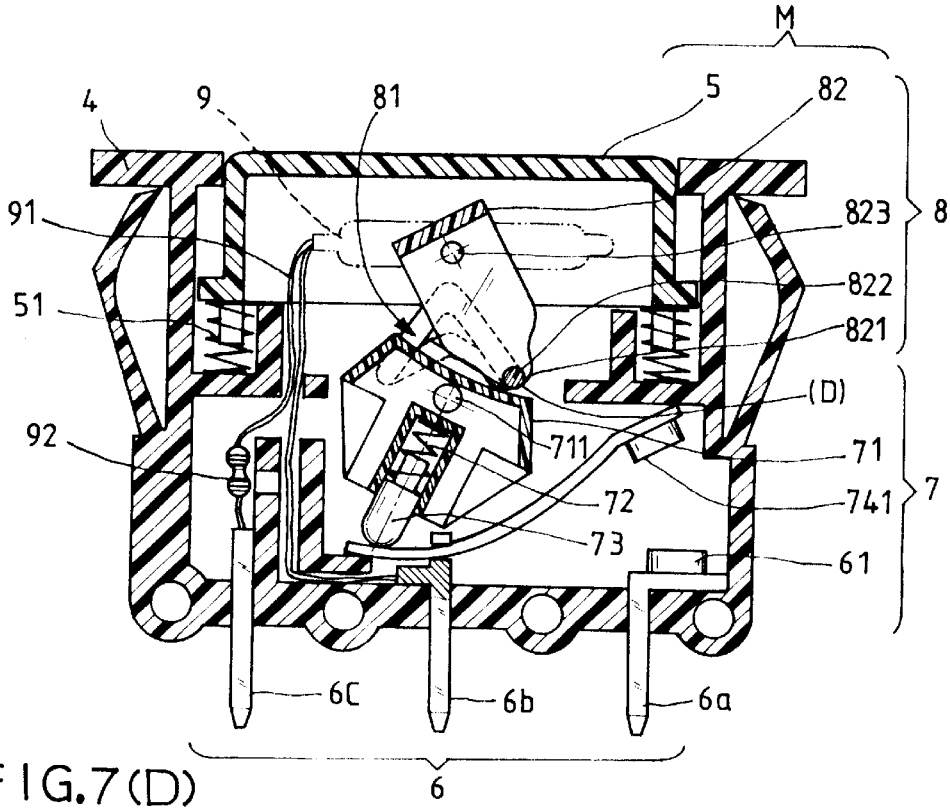
Figure 7:
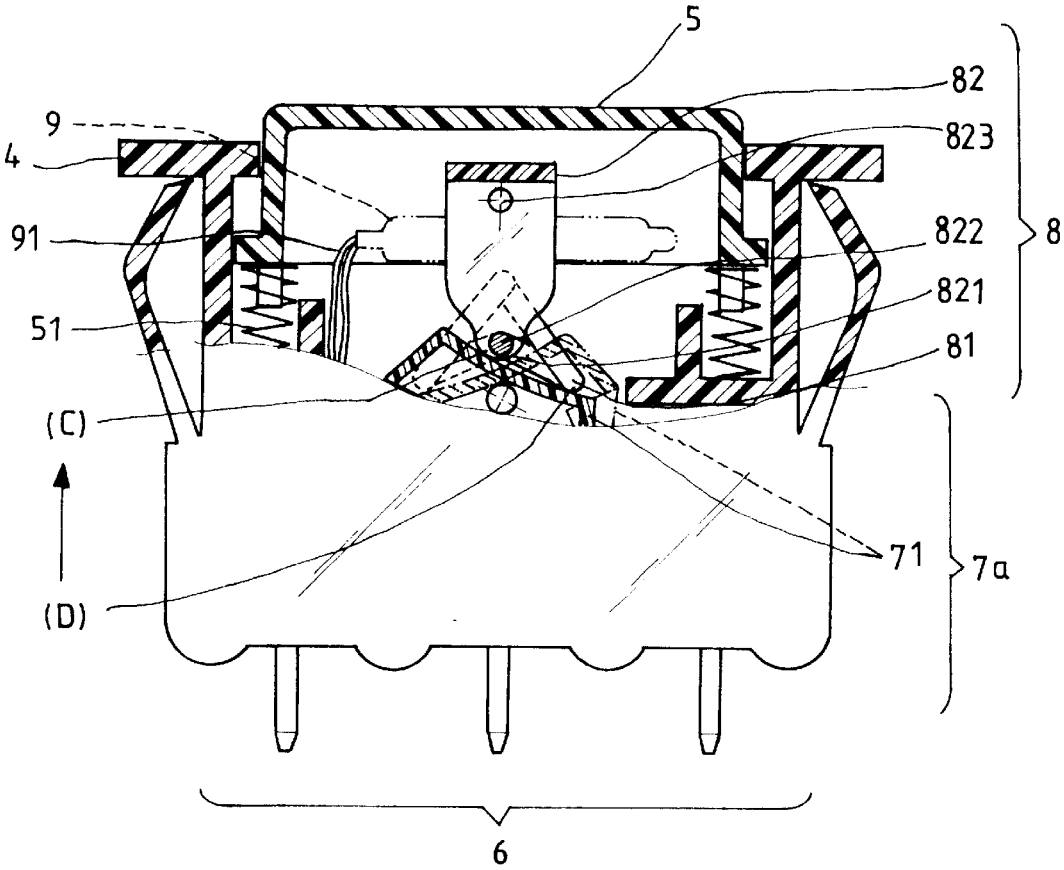

Further, a neo lamp 9 is connected between the second terminal 6*b* and the third terminal 6*c*, and a resistor 92 is installed in one lead wire 91 of the neo lamp 9 to the third terminal 6*c*. When the switch switched on, the neo lamp 9 is turned on. When wishing to switch off the switch, press the press button 5 to the lower limit position as shown in FIG. 7D. At this time, the guide rods 822 are moved along the third sliding rail 813 to the second turning point D (see FIG. 9) to tilt the plant 71, thereby causing the metal contact plate 74 of the seesaw switching mechanism 7 to be disconnected from the first terminal 6*a*, and therefore the switch is switched off. When released the press button 5, the guide rods 822 are moved from the second turning point D along the fourth sliding rail 814 to the top positioning point A shown in FIG. 7A, keeping the switch in "off" position.

Furthermore, because the press button switch uses a seesaw switching mechanism for switching the circuit between on/off positions, the seesaw switching mechanism can be made to trip off automatically upon an overload by means of the application of the known techniques, for example, the use of a metal contact plate that changes the shape subject to a significant temperature change.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A press button switch comprising:

(a) a housing, having a top opening and a side cover covered on one lateral open side thereof;

(b) spring means mounted inside said housing;

(c) at least two terminals mounted in said housing for connecting to a power source;

(d) a seesaw switching mechanism, installed within said housing and having a plank with a first stable position and a second stable position, wherein said first stable position closes a circuit between said at least two terminals and said second stable position opens the circuit between said at least two terminals between;

(e) a press button mounted in the top opening of said housing and supported on said spring means for pressing by hand; and (f) an actuating structure controlled by said press button and juxtaposed with said seesaw switching mechanism to displace said seesaw switching mechanism between said first stable position and said second stable position; wherein said actuating structure includes:

a pair of endless sliding tracks bilaterally provided inside said housing, said pair of endless sliding tracks each including a top positioning point disposed in a top side thereof for supporting said seesaw switching mechanism in said first stable position, and a bottom positioning point vertically spaced below said top positioning point and supporting said seesaw switching mechanism in said second stable position, a first turning point located away from said bottom positioning point at a left lower side and for guiding said seesaw switching mechanism from said first stable position to said second stable position, and a second turning point located away from said bottom positioning point at a right lower side for guiding said seesaw switching mechanism from said second stable position to said first stable position; and a push member pivotaly connected to said press button at a bottom side thereof, said push member including at least two bottom push portions respectively supported on said plank of said seesaw switching mechanism for synchronous movement with said push member to reversibly move said seesaw switching mechanism between said first stable position and said second stable position, and two guide rods extending from two opposite lateral sides of said push member and respectively slidably coupled to said pair of endless sliding tracks for guiding movement of said push member to displace said seesaw switching mechanism between said first stable and said second stable positions.

2. The press button switch as claimed in claim 1, wherein said push member is a substantially Π-shaped member, having two horizontal pivot rods bilaterally disposed near a top side thereof and respectively coupled to respective pivot holes of said press button.

3. The press button switch as claimed in claim 1, wherein said plank of said seesaw switching mechanism has a protruded middle portion, and two elongated side bearing portions disposed at two sides of said protruded middle portion at a lower elevation than said protruded middle portion for supporting the bottom push portions of said push member.

4. The press button switch as claimed in claim 3, wherein said elongated side bearing portions of said plank of said seesaw switching mechanism are respectively downwardly sloping toward two opposite lateral sides of said protruded middle portion.

5. The press button switch as claimed in claim 1, wherein said endless sliding tracks of said actuating structure each are formed of a first sliding rail, said first sliding rail having a first end and a second end, a second sliding rail, said second sliding rail having a first end connected to the second end of said first sliding rail and forming with the second end of said first sliding rail said first turning point and a second end, a third sliding rail, said third sliding rail having a first end connected to the second end of said second sliding rail and forming with the second end of said second sliding rail said bottom positioning point and a second end, and a fourth sliding rail, said fourth sliding rail having a first end connected to the second end of said third sliding rail and forming with the second end of said third sliding rail said second turning point and a second end connected to the first end of said first sliding rail and forming with the first end of said first sliding rail said top positioning point.

* * * * *